United States Patent [19]

Coleman et al.

[11] 4,102,494

[45] Jul. 25, 1978

[54] AIR DISTRIBUTION SYSTEM

[75] Inventors: Milton H. Coleman, East Syracuse; William E. Clark, Syracuse, both of N.Y.

[73] Assignee: Carrier Corporation, Syracuse, N.Y.

[21] Appl. No.: 792,387

[22] Filed: Apr. 29, 1977

[51] Int. Cl.[2] ..... F24F 11/02

[52] U.S. Cl. ..... 236/1 B; 236/13; 165/30

[58] Field of Search ..... 236/49, 13, 1 B, 80 B; 165/39, 30; 98/40 N

[56] References Cited

U.S. PATENT DOCUMENTS

| | | | |
|---|---|---|---|
| 2,609,743 | 9/1952 | Ashley et al. | 98/33 R |
| 3,934,795 | 1/1976 | Ginn et al. | 236/80 B |
| 4,014,381 | 3/1977 | Clark | 165/30 |

*Primary Examiner*—William E. Wayner

*Attorney, Agent, or Firm*—J. Raymond Curtin; Barry E. Deutsch

[57] ABSTRACT

An air conditioning system for conditioning the air in a plurality of enclosed areas in a building. Conditioned air at a temperature level which may be varied is supplied to a first terminal for discharge into an area. Conditioned air at a relatively constant temperature level is delivered to a second terminal for discharge into the area. The quantity of constant temperature air discharged into the area is regulated in accordance with the temperature level therein. The quantity of the variable temperature air stream discharged into the area is regulated in accordance with the quantity of constant temperature air discharged into the area. As the quantity of constant temperature air discharged into the room is increased, the quantity of variable temperature air discharged into the room will be decreased if the variable temperature air supply is at a relatively warm level, and may be increased if the variable temperature air supply is at a relatively cold level; and as the quantity of constant temperature air discharged into the room is decreased, the quantity of variable temperature air discharged into the room will be increased if the variable temperature air supply is relatively warm and will be decreased if the temperature of the variable temperature air supply is relatively cold.

5 Claims, 3 Drawing Figures

AIR DISTRIBUTION SYSTEM

BACKGROUND OF THE INVENTION

This invention relates to air conditioning systems for conditioning air in a plurality of areas or spaces in a common enclosure, and more particularly, relates to a control for regulating the operation of such systems.

In recent years, many multi-zone buildings, such as schools, offices, apartments and hospitals have employed central station air conditioning systems to provide conditioned air to regulate the psychometric properties of the air in each of the zones of the building. One air conditioning system that has enjoyed widespread commercial success is known as a dual conduit system. A dual conduit system is designed to supply two air streams to enclosed areas or rooms that have a reversing transmission load; that is, during summer heat flows from the ambient and into the building, whereas during winter, heat flows from the building to the ambient. One air stream, called secondary air, is cooled the year around and is constant in temperature and variable in volume. Secondary air is a constant temperature-variable volume air stream. The other air stream, called the primary air, is constant in volume and the air temperature is varied; it is warm in winter and cool in summer. Primary air is therefore, a constant volume-variable temperature air stream. To obtain the two air streams, central station air conditioning apparatus is employed to provide the air temperature and volumes required.

The primary air conditioning apparatus varies the psychometric properties of the air supplied thereto, which may comprise a mixture of outdoor and return air or under some conditions, may comprise all return air. The apparatus includes filters to remove dirt or foreign matter entrained in the air, preheat coils as required to temper cold winter air, a humidifier to add winter humidification and a dehumidifier to remove excess moisture and to cool the supply air furnished at a constant volume to the enclosed areas within the building.

The secondary air conditioning apparatus also varies the psychometric properties of the air supplied thereto and supplies either/or all return air, a mixture of outdoor and return air, or all outdoor air, depending upon the season. The apparatus contains filters to remove dirt and foreign matter entrained in the air and a dehumidifier to remove excess moisture and/or to cool the supply air.

A refrigeration machine is necessary to complete the overall system. Any of the three basic refrigeration cycles, absorption, reciprocating, or centrifugal may be considered for the refrigeration equipment. Either chilled water from the refrigeration machine or direct expansion of refrigerant may be used to obtain the desired temperature for the supply air. The foregoing system is completely described in U.S. Pat. No. 2,609,743, issued Sept. 9, 1952, in the names of Carlyle M. Ashley and William T. McGrath.

Typically, the primary air supply is connected to an air conditioning terminal serving the peripheral portion of the enclosed area or room. The secondary air supply is connected to a terminal serving the interior portion of the room. The delivery of air to each of the two separate portions of the room may actually be accomplished via a single air conditioning terminal of the type disclosed in U.S. Pat. No. 3,867,980 in the name of Darwin G. Traver, and assigned to the same assignee hereof.

Alternatively, the supply of conditioned air to the two separate portions of the enclosed area may be accomplished via two separate air conditioning terminals. The discharge of primary air is designed to offset transmission gains or losses; whereas the discharge of conditioned secondary air is designed to offset a relatively constant heating load created by lights, people, and machinery.

Heretofore, in many systems of the type described, the supply of secondary air has been maintained completely independent from the supply of primary air. That is to say, there has been no interrelationship between the quantity of secondary air discharged into the space and the quantity of primary air discharged thereinto.

During the heating season, this lack of interdependence between the supply of primary air and secondary air has at times, resulted in the simultaneous discharge of both relatively warm and cold air into the area. As is manifest, the foregoing is not desirable when conservation of energy and the reduction of operating costs are desired.

In order to prevent conditions from occurring wherein, in effect, the supply of conditioned secondary and primary air streams are "bucking" each other, it is desirable to control the quantity of primary air discharged inversely to the quantity of secondary air supplied into the space or area. For example, during the heating or winter season, designers and installers of systems of the type described, have assumed once the ambient temperature declined below a certain level, for example 50° F, relatively warm primary air would always be required to offset transmission losses to the ambient through the peripheral walls of the building. However, at times during winter operation, the presence of solar radiation will negate transmission losses to the ambient, thereby making the continued discharge of relatively warm primary air undesirable. During the cooling season, it is also desirable to regulate the supply of primary air in accordance with the actual requirements of the space being conditioned. If a constant volume of primary air is furnished during the cooling season, the area may either be overcooled or undercooled at various times.

In effect, during the heating and cooling seasons, it is desirable to change the primary air system from a constant volume supply to a variable volume supply. Although two thermostats may be employed to regulate the flow of both primary and secondary air streams, if operation of the thermostats is independent with respect to each other, each thermostat may be separately set so that warm primary and cold secondary air may be simultaneously discharged. As noted heretofore, the simultaneous discharge of the separate air streams is undesirable, particularly when the conservation of energy is critically important.

A system that has attempted to remedy the above described problems is disclosed in U.S. Pat. No. 3,952,795, issued in the name of William E. Clark. The system disclosed in this patent provides for dependent regulation of the primary and secondary air streams, when the primary air stream temperature is relatively warm. However, the primary air is supplied at a constant volume when the temperature thereof is relatively cold. The only volume control for the system under such conditions is volume regulation of the secondary air stream. The lack of control in the cooling mode of primary air distribution may cause discomfort in that areas may become overly cool due to the continued discharge of a constant volume of relatively cold air irrespective of actual temperature conditions in the area being conditioned.

SUMMARY OF THE INVENTION

It is an object of the present invention to control the quantity of primary air discharged into an area in proportion to actual temperature requirements therein, irrespective of the temperature of the primary air.

It is a further object of this invention to reduce the quantity of warm primary air discharged into an area as the quantity of secondary air discharged thereinto is increased and to increase the quantity of warm primary air as the quantity of secondary air is decreased.

These and other objects of the present invention are obtained in an air conditioning system for conditioning air in a plurality of enclosed areas in a building. Conditioned air at a temperature level which may be varied is supplied to first terminal means for discharge into an area. Conditioned air at a relatively constant temperature level is delivered to second terminal means for discharge into an area. The quantity of constant temperature air is regulated in accordance with the temperature requirements of the area. When the variable temperature air is relatively warm, a control signal, the magnitude thereof being indicative of the quantity of constant temperature air discharged into the area, is generated, and is supplied to control means operable to vary the quantity of warm temperature air supplied into the area in accordance with the magnitude of the control signal. As the quantity of constant temperature air discharged into the room is increased, the quantity of warm air discharged into the room is decreased; and as the quantity of constant temperature air discharged into the room is decreased, the quantity of warm air discharged into the room is increased. When the variable temperature air is relatively cold, the quantity thereof discharged into the room is regulated to satisfy the actual thermal requirements of the room.

DESCRIPTION OF THE PREFERRED EMBODIMENT

Figure 1:
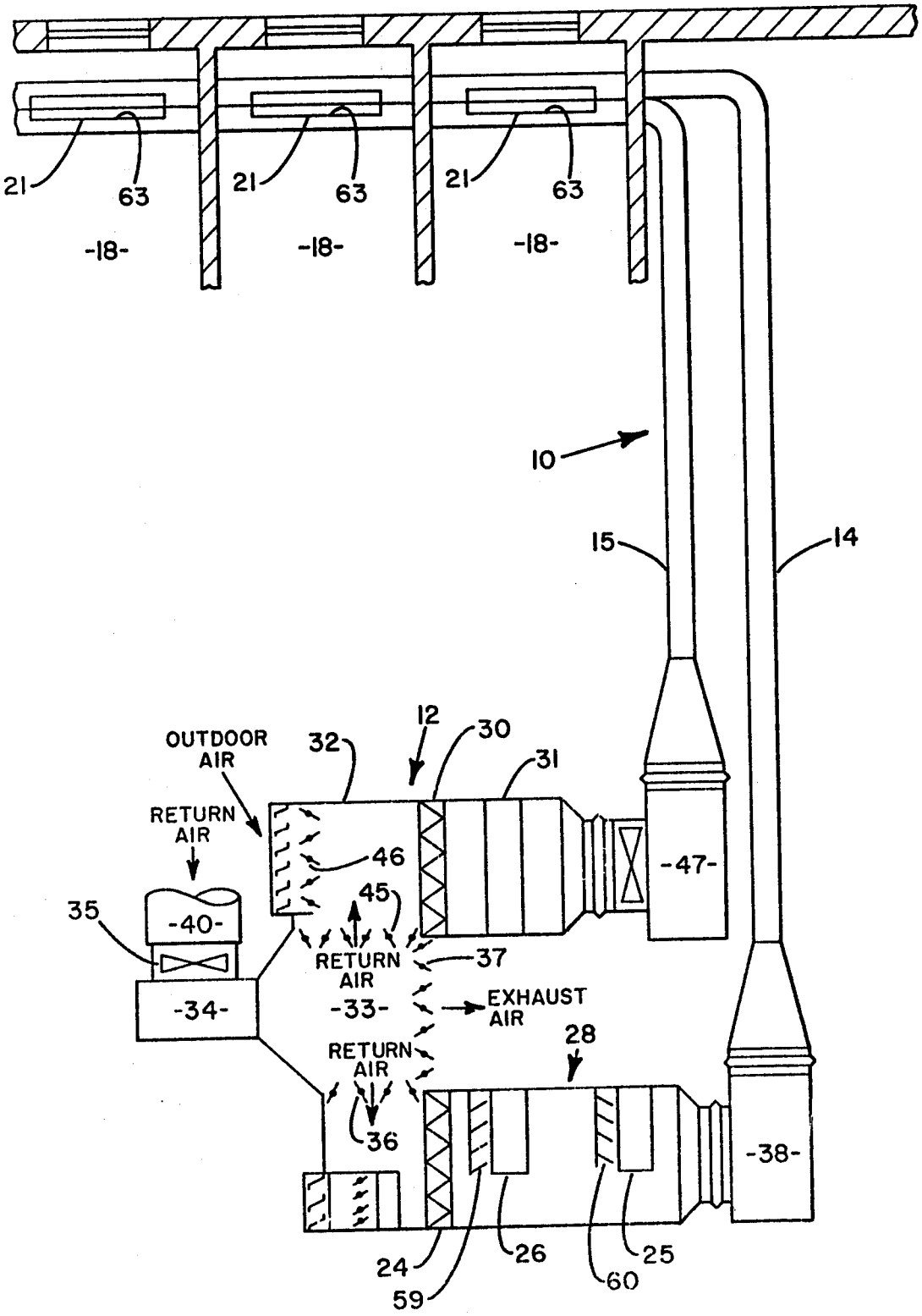
FIG. 1 schematically illustrates an air conditioning system in accordance with the present invention.

Referring now to FIG. 1, there is shown an air conditioning system of a type to which the present invention pertains. Air conditioning system 10, which may be described as a central station type, includes an air conditioning equipment section generally designated by the numeral 12, and a conduit system 14, 15, for conducting conditioned primary and secondary air respectively, to each of the areas or rooms provided within a common enclosure and served by the system. Equipment section 12 may be located in a basement or on the roof of a building.

For the purpose of this description, primary air may comprise fresh air or ventilating air drawn from the outdoors, or a mixture of outdoor air and return air treated in section 12, while secondary air may comprise return air from the areas being conditioned and treated in section 12. The apparatus for conditioning the primary air preferably includes a filter 24 to remove foreign matter entrained in the air, heating or reheating coil 26 to elevate the temperature of the air flowing in the primary air system or circuit and a cooling or dehumidifying coil 25 to remove excess moisture and to cool the supply air as required, arranged in series flow relationship and encased within a suitable housing 28. The passage of primary air over coils 25 and 26 is regulated by dampers 59 and 60.

The portion of the central station equipment regulating the secondary air preferably includes a suitable filter 30 to remove foreign matter entrained in the air and a dehumidifier or cooling coil 31 to remove the excess moisture and/or cool the supply air, arranged in series flow relationship and encased within a suitable housing 32. Chilled water is supplied to coils 25 and 31 via suitable means (not shown).

Housings 28 and 32 are connected by duct 33 with return air exhaust fan 34. The inlet of fan 34 is connected with return air plenum 40 which is connected by suitable means (not shown) with the areas or rooms being served by the air conditioning system. Preferably, inlet air control vanes 35 are provided to vary the flow of air through fan 34. Adjustable members 36 are provided to vary the flow of return air to the primary air conditioning apparatus. The exhaust dampers 37 connect exhaust duct 33 with the outdoors. Dampers 37 control the volume of return air discharged to the atmosphere. Housing 28 connects with primary air fan 38. Conduit means 14 conveys primary air from fan 38 to the areas or rooms being conditioned. Housing 32 is connected to the outlet of return air fan 34. Preferably, adjustable dampers 45 are provided to vary the flow of supply air to the secondary air conditioning apparatus. Adjustable dampers 46 are provided to regulate the flow of outdoor air to the secondary air conditioning apparatus. Conduit means 15 conveys air from fan 47 to the area or rooms being conditioned. Conduit means 14 and 15 provide the primary air and secondary air respectively to each air terminal 21 disposed in each of the respective areas or rooms 18.

Figure 2:
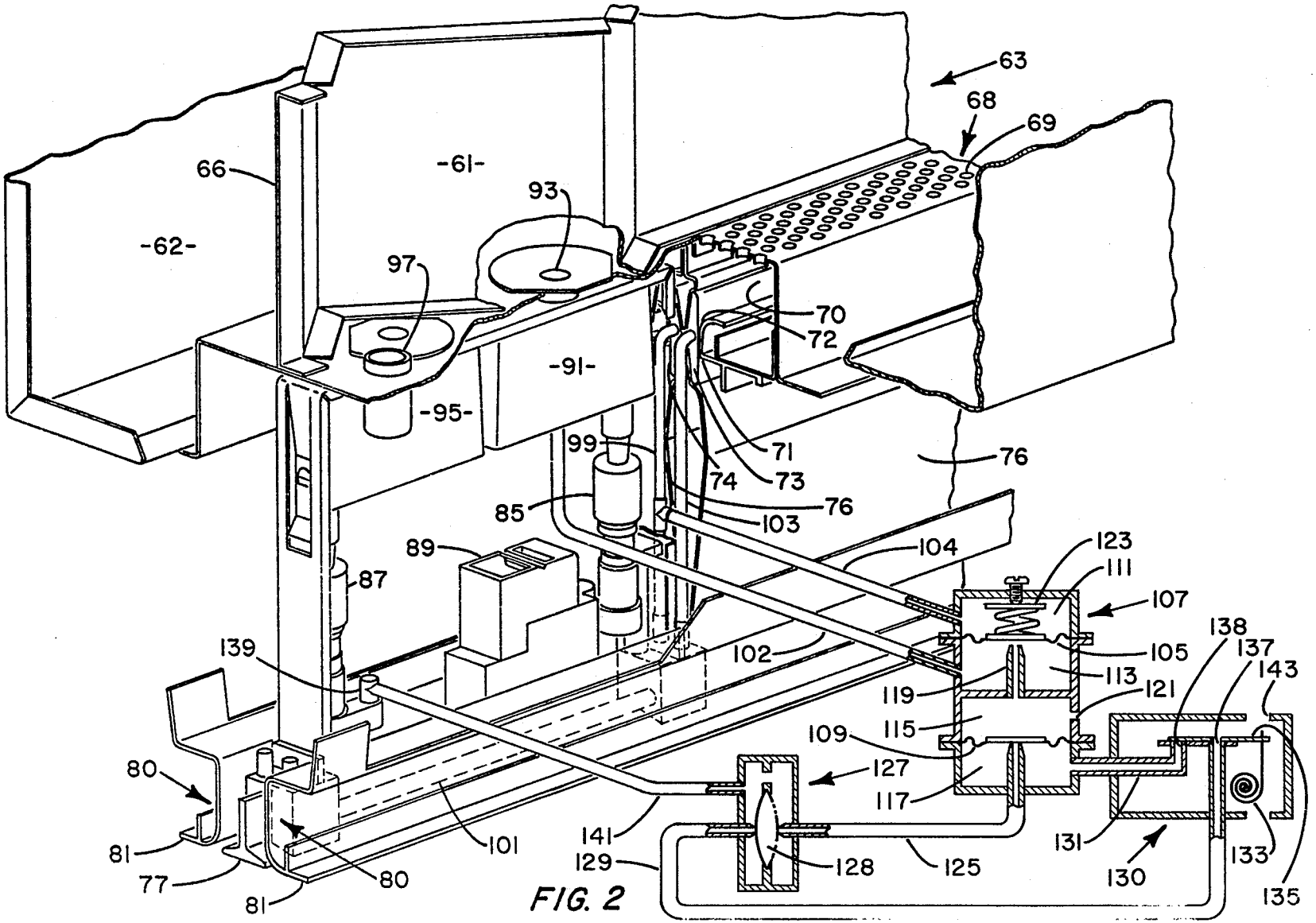
FIG. 2 illustrates a perspective view of an air conditioning terminal with a control therefore, illustrated partially in section and partially in schematic.
Figure 3:
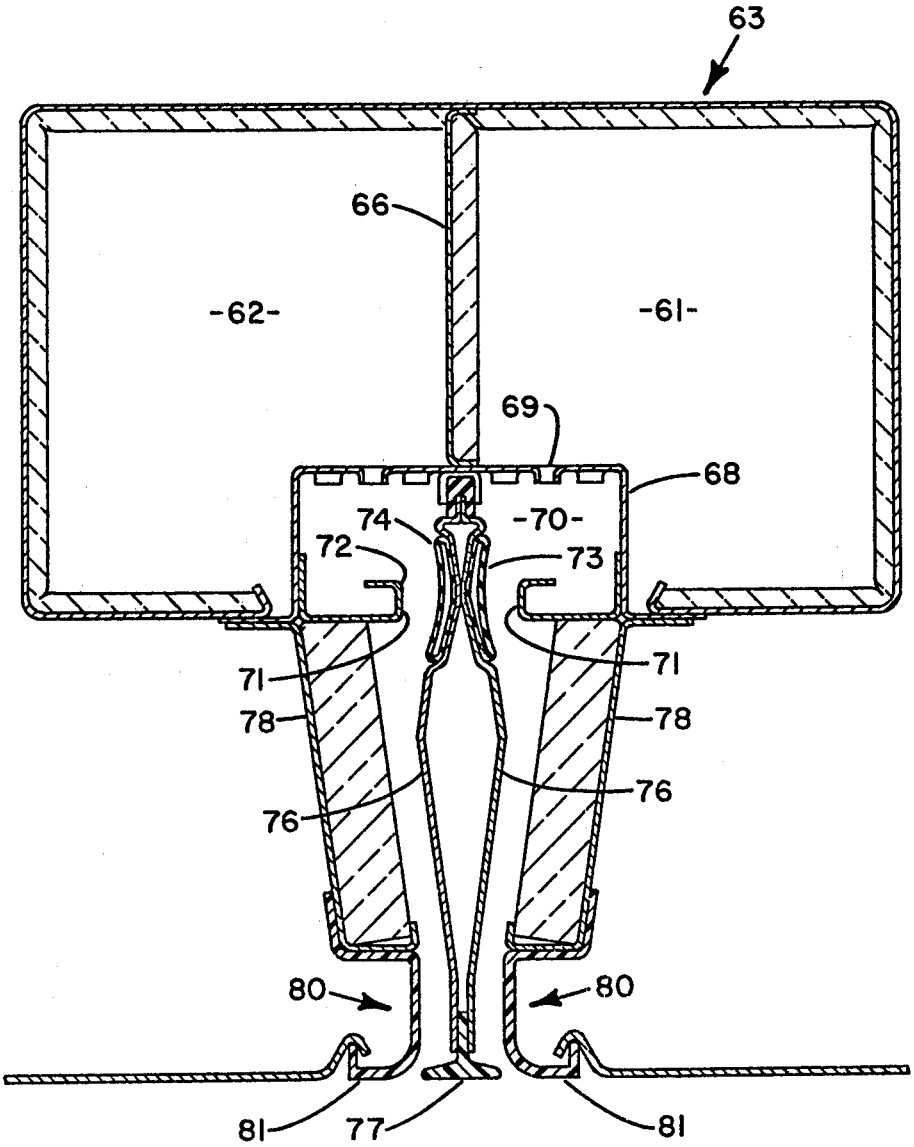
FIG. 3 is a sectional view of the air conditioning terminal illustrated in FIG. 2.

Referring now to FIGS. 2 and 3, there is disclosed a preferred form of terminal and a control therefore in accordance with the present invention. In a typical system of the type to which the present invention relates, a separate terminal, to be described in detail hereinafter, will be disposed in each individual space or room being conditioned. Conduit means 14 and 15 terminate in a plenum section 63 of each terminal. The plenum section is ordinarily lined with a sound absorbing material, such as a glass fiber blanket. A baffle or partition member 66 divides the plenum into first and second sections or portions 61 and 62 for respective connection to conduit means 14 and 15. The baffle thereby maintains the primary air separate from the secondary air so that there is no intermixing therebetween.

An air supply distribution plate 68 having a plurality of openings 69 is provided to evenly distribute the supply air from plenum 63 to distribution chamber 70 which is defined by the top and side walls of distribution plate 68. A portion of the distribution plate is disposed on either side of baffle 66 so primary air moves into a first portion of distribution chamber 70 and secondary air moves into a second portion of the chamber.

The bottom of distribution chamber 70 includes aligned cutoff plates 71 which are provided with a curved surface 72 for engagement by bladders or bellows 73 and 74 to form a damper. By varying the inflation of the bladders, the area of the opening between each of the bladders and cutoff plates may be varied to thereby regulate the quantity of conditioned air discharged into the area or space being conditioned. The manner in which the inflation of the bladders is controlled shall be explained in detail hereinafter.

The bladders are adhesively mounted on a central partition assembly comprised of opposed generally convex plates 76 and a diffuser triangle 77. The plates have a V-shaped recessed area so the bladders are completely recessed within the plates when deflated. This provides a large area between the active walls of the bladders and the outoff plates for maximum air flow therebetween. Further, the recessed bladder provides a smooth surface along plate 76 to minimize air turbulence.

The damper mechanism is disposed a substantial distance upstream from the discharge openings in the terminal to provide sufficient space therebetween to absorb any noise generated by the damper mechanism. For maximum sound absorption, downwardly extending walls 78 which form air passages in conjunction with plates 76 are lined with a suitable sound absorbing material, such as a glass fiber blanket. Outlet members 80 having outwardly flared portions 81 are affixed, as by welding, to walls 78. For a more detailed explanation of the air terminal, reference may be made to U.S. Pat. No. 3,867,980 in the name of Darwin G. Traver and assigned to the same assignee as the assignee thereof.

The terminal further includes a control section comprising a first regulating device 85, a second regulating device 87, and a thermostat 89. Preferably, regulators 85 and 87 are of the type disclosed in U.S. Pat. No. 3,434,409, issued in the name of Daniel A. Fragnito, and thermostat 89 is of the type disclosed in U.S. Pat. No. 3,595,475, issued in the name of Daniel H. Morton. Each of the foregoing patents are assigned to the same assignee as the assignee hereof.

Regulator 85 is responsive to the pressure of the secondary air supplied via conduit means 15 to plenum portion 62. Thermostat 89 is operably connected to regulator 85 for a reason to be more fully described hereinafter. A filter 91 is provided to filter the secondary air passing from plenum section 62 to the regulator via opening 93.

Similarly, a filter 95 is provided to filter the primary air passing to regulator 87 from plenum section 61 via opening or orifice 97. Openings 93 and 97 are provided on opposite sides of baffle plate 66. Regulator 85 is suitably joined via line 99 to the bladder regulating the discharge of secondary air from plenum section 62 through the terminal. Similarly, regulator 87 is joined via lines 101 and 103 to the bladder regulating the discharge of primary air from plenum section 61. Regulators 85 and 87 are provided to generate a control signal indicative of the pressures of the secondary and primary air in the respective plenum sections. The regulators increase a control signal supplied to the bladders to thereby increase the inflation thereof as the air pressure in the plenums increase and operate to decrease the magnitude of the control signal supplied to the bladders as the pressure of the air in the plenum sections decrease. By varying the inflation of the bladders or bellows in accordance with changes in supply air pressure, a relatively constant quantity of air may be discharged from the unit or terminal irrespective of variations in supply air pressure.

As noted before, thermostat 89 is associated with regulator 85. Thermostat 89 is preferably a bleed type thermostat which operates to reduce the pressure signal supplied from regulator 85 to the bladder as the temperature of the space increases above the design level to thereby decrease the inflation of the bladder and increase the quantity of conditioned air supplied into the space. If the temperature of the space falls below the set point temperature, the thermostat bleed closes to increase the magnitude of the control signal supplied to the bladder so that it approaches its maximum value as determined by the supply air pressure. The resultant increase in the magnitude of the signal will cause the bladder to inflate to decrease the quantity of secondary air supplied to the space.

As noted previously, it has generally been the practice to maintain the supply of primary air into each space at a substantially constant rate. However, it has now been recognized that the supply of primary air should be varied in accordance with actual temperature requirements in the space being conditioned. For example, during the heating season, when the temperature of the primary air is relatively warm, the supply thereof is not always required. Similarly, during the cooling season, when the temperature of the primary air is relatively cold, a constant supply of primary air is not always required to maintain the desired temperature in the space being conditioned.

To obtain the above-described benefits, the present invention includes pneumatic relay 107. Relay 107 includes first and second bellows or diaphragms 105 and 109, respectively dividing the relay into compartments 111 and 113; and 115 and 117. Line 104 communicates compartment 111 with a portion of the system that is at the pressure of the bladder or bellows controlling the discharge of secondary air, for example line 99. Thus, a force corresponding to the pressure in bellows 73 acts on the top surface of diaphragm 105. A second line 102 communicates chamber 113 with plenum section 62 so the lower surface of diaphragm 105 is responsive to the pressure of the air in the plenum section. A spring 123 is provided in chamber 111 to provide an additional force on the top surface of diaphragm 105. Line 119 communicates chamber 113 with chamber 115. Chamber 115 includes a relatively small bleed orifice 121.

The system further includes a thermostat 127 having a bimetallic element 128 responsive to the temperature of the air delivered to plenum section 61.

Thermostat 127 communicates through line 141 with regulator 87. Regulator 87 controls the flow of primary air into each space in accordance with the variations of duct pressure in plenum section 61. Bimetallic element 128 selectively directs the control signal delivered to thermostat 127 through line 141, through first or second flow paths defined by conduits 125 and 129. When element 128 is in its solid line position, line 141 and conduit 125 are in communication, and when in its dotted line position, line 141 and conduit 129 are in communication.

Conduit 125 delivers the control signal from thermostat 127 to lower chamber 117 of pneumatic relay 107. Conduit 129 delivers the control signal to a second thermostat 130.

Thermostat 130 has a bimetallic element 133 connected to movable plate 135. Plate 135 overlays ports 137 and 138. Conduit 129 terminates at port 137. A conduit 131 communicating chamber 117 of relay 107 with thermostat 130 terminates at port 138. Thermostat 130 further includes an orifice or port 143 which permits the flow of air from ports 137, 138 to the conditioned space or other low pressure area. Plate 135 is designed to move relative to ports 137 and 138 to regulate the flow of air therethrough.

OPERATION

Initially, it shall be assumed that the system is operating during winter conditions. Accordingly, the primary air supplied via conduit means 14 to plenum section 61 is at a relatively warm temperature level to compensate for transmission losses to the ambient. The supply of secondary air through conduit means 15 to plenum section 62 is at a relatively cold level.

The quantity of secondary air discharged into the area or space being conditioned is under the control of both regulator 85 and thermostat 89 whereby the quantity of air discharged is varied in accordance with the temperature demands of the space.

Even though the ambient temperature is at a relatively low level, there are times when transmission losses through the walls of the building will be compensated for by solar radiation thereby eliminating the need for relatively warm primary air.

If solar radiation has negated transmission losses, the continued discharge of relatively warm primary air raises the temperature level in the space so thermostat 89, in conjunction with regulator 85, operates to reduce the pressure signal supplied to bladder 74. The bladder is deflated as a result of the reduced pressure signal to thereby permit a greater quantity of secondary air to be discharged into the area.

As noted previously, line 104 is in communication with chamber 111 of relay 107 to develop a pressure in the chamber which is directly related to the pressure in bladder 74. As the magnitude of the pressure signal delivered to chamber 111 is decreased, due to the requirement for a greater quantity of secondary air in the space, the relatively high pressure air signal provided to chamber 113 via line 102 causes diaphragm 105 to move upwardly to thereby open line 119 to permit the flow of air from section 113 to section 115. Thus, a force corresponding to the pressure of the air furnished to plenum section 62 is developed on the top surface of diaphragm 109. The relatively high pressure acting against the top surface of the diaphragm causes the diaphragm to prevent flow of air through conduit 125. As noted previously, during the portion of time when warm primary air is supplied, bimetallic element 128 of thermostat 127 is in its solid line position whereby conduits 141 and 125 are in communication.

As the temperature in the space decreases due to the continued discharge of relatively cold air thereinto, the pressure in chamber 111 will approach the pressure in chamber 113. This will result from the operation of thermostat 89, causing an inflation of control bladder 74 to reduce the flow of secondary air.

Under such conditions, the combined forces developed by spring 123 and the pressure of the air in chamber 111 will cause diaphragm 105 to terminate the flow of control air through line 119. Air will be bled from chamber 115 through port 121 whereby the pressure acting on the top surface of diaphragm 109 will be reduced. The pressure of the air acting on the lower surface of the diaphragm will cause the diaphragm to move upwardly relative to conduit 125 to permit the flow of air from conduit 125 to conduit 131. Bimetallic element 133, responsive to the temperature in the space being conditioned, will thence move plate 135 relative to port 138 to regulate the flow of air from conduit 131 to port 141.

If the temperature of the space being conditioned continues to fall below a desired temperature level, element 133 will move plate 135 so as to open port 138. This will result in a continuous flow of control air from line 141, through conduits 125 and 131, to the low pressure region via orifice 143. The continuous flow of control air through the path thus described will reduce the pressure in the bladder 73 to permit a greater flow of relatively warm primary air into the space. As the temperature in the space increases due to the continued flow of relatively warm temperature primary air into the space, bimetallic element 133 moves plate 135 to close off port 138. The subsequent termination of the flow of control air through line 141 and conduits 125 and 131 results in an increase in the pressure of the control signal passing to the primary air bladder. The resultant increased inflation of the bladder will reduce the flow of primary air into the space being conditioned.

Thus, during winter operation, the quantity of primary air discharged into the space being conditioned is fully regulated by the combined operation of relay 107 and thermostats 127 and 130. The controls will function to prevent the concurrent discharge of both primary and secondary air streams during winter operation.

During summer operation, when the supply of primary air is at a relatively cold temperature level, thermostatic element 128 will move to its dotted line position to terminate communication between line 141 and conduit 125 and to communicate line 141 with conduit 129.

During summer operation, the flow of secondary air will still be under the control of regulator 85 and thermostat 89. Thus, with bimetallic element 128 being positioned in the manner described, relay 107 is essentially rendered inoperative relative to the control of the air flow through the system. The control of secondary air during summer operation is through regulator 85 and thermostat 89. The control of primary air is via thermostat 130. With line 141 and conduit 129 in communication, port 137 is operative and port 138 is inoperative. Thus, bimetallic element 133 will move plate 135 relative to port 137 so as to regulate the flow of primary air into the space. As the temperature in the space increases above set point, element 133 will move plate 135 so as to open the port to thereby reduce the pressure in control bladder 73. Conversely, as the temperature in the space approaches set point, element 133 will move plate 135 to close off port 137 and thereby increase the pressure signal flowing to the primary air control bladder. Thus, during summer operation, the quantity of primary air discharged into the space may be varied in accordance with the temperature therein as sensed by thermostat 133. The combined flow of the relatively cold primary and secondary air streams will maintain the desired temperature level in the space. The space will not be overcooled as has heretofore sometimes occurred due to the practice of maintaining a constant flow of primary air.

The aforedescribed system effectively maintains control of the primary air during both summer and winter seasons whereby the flow of air is regulated in accordance with actual temperature requirements of the space being conditioned.

While a preferred embodiment of the present invention has been described and illustrated, the invention should not be limited thereto but may be otherwise embodied within the scope of the following claims.

We claim:

1. In an air conditioning system for conditioning the air in a plurality of enclosed areas in a building, each of the enclosed areas having a peripheral portion requiring conditioned air having a variable temperature, and an interior portion requiring conditioned air at a constant temperature, terminal means disposed in each of the enclosed areas for the supply of conditioned air thereinto; first air conditioning apparatus to provide conditioned air at a temperature level which may be varied; means to supply said varying temperature conditioned air to a first portion of said terminal means; second air conditioning apparatus to provide conditioned air at a relatively constant temperature level; means to supply said relatively constant temperature air to a second portion of said terminal means; said terminal means including first control means to regulate the quantity of said constant temperature air discharged into said area in accordance with the temperature in said interior portion of said area, including means to generate a variable magnitude control signal indicative of the quantity of constant temperature air discharged into said area; and second control means responsive to a second control signal to regulate the quantity of said variable temperature air discharged into said area, the improvement comprising:

temperature responsive means to sense the temperature of said variable temperature conditioned air and to selectively direct said second control signal through first and second flow paths in response to said sensed temperature;

valve means interposed in said second flow path and responsive to the magnitude of said first control signal to transmit said second control signal when the magnitude of said first signal increases above a predetermined level and to terminate the transmission of said second control signal when the magnitude of said first signal decreases below said predetermined level; and thermostatic means interposed in said first and second flow paths to vary the magnitude of said second control signal including means responsive to the temperature of the air in the space being conditioned to regulate the flow of said second control signal through said first and second flow paths in accordance with the sensed air temperature to vary the magnitude of said second control signal to vary the volume of said variable temperature air stream discharged into said space irrespective of the temperature of said air stream.

2. In an air conditioning system for conditioning air in a plurality of enclosed areas in a building, each of the enclosed areas having a peripheral portion requiring conditioned air having a variable temperature and an interior portion requiring conditioned air at a constant temperature, terminal means disposed in each of the enclosed areas with a supply of conditioned air thereinto, first air conditioning apparatus to provide conditioned air at a temperature level which may be varied; means to supply said varying temperature conditioned air to a first portion of said terminal means; second air conditioning apparatus to provide conditioned air at a relatively constant temperature level; means to supply said relatively constant temperature air to a second portion of said terminal means; said terminal means including first control means to regulate the quantity of said constant temperature air discharged into said area in accordance with the temperature of said interior portion of said area, including means to generate a variable magnitude control signal indicative of the quantity of constant temperature air discharged into said area; and second control means to regulate the quantity of said variable temperature air discharged into said area, the improvement comprising:

pressure regulator means having an inflatable bellows connected thereto, said regulator means varying the degree of inflation of said bellows in accordance with the pressure of said air delivered through said variable temperature air supply means, said regulator means further generating a second control signal;

temperature responsive means to sense the temperature of said variable temperature conditioned air and to selectively direct said second control signal through first and second flow paths in response to said sensed temperature;

a relay interposed in said first flow path and having a first portion to receive said first variable magnitude control signal and a second portion to transmit said second control signal, and valve means to selectively control the transmission of said second signal in accordance with the magnitude of said first signal; and thermostatic means interposed in said first and second flow paths to vary the magnitude of the second control signal, including a bimetallic member responsive to the temperature of the air in the space being conditioned to regulate the flow of air through said first and second flow paths, said bellows being inflated to prevent the discharge of conditioned air from said second air terminal means when said bimetallic member prevents flow of said second control signal through either of said first or second flow paths.

3. An air conditioning system in accordance with claim 2 wherein the temperature of the constant temperature air is relatively cold, said valve means transmitting the second control signal when the flow of said relatively cold conditioned air from said terminal means is terminated.

4. A method of operating an air conditioning system for conditioning air in a plurality of enclosed areas in a building, each of the enclosed areas having a peripheral portion requiring conditioned air having a variable temperature, and an interior portion requiring conditioned air at a constant temperature wherein a variable temperature conditioned air stream is delivered to a terminal serving the peripheral portion of the area; a constant temperature air stream is delivered to a terminal serving the interior portion of the air and the quantity of the relatively constant temperature air discharged into the area is varied in accordance with the temperature conditions therein; wherein the improvement comprises:

generating a control signal, the magnitude thereof varying in accordance with the quantity of constant temperature air supplied to the area;

sensing the temperature of the variable temperature conditioned air furnished to the terminal serving the peripheral portion of the area to selectively direct the second control signal through first or second flow paths depending upon the sensed temperature of the variable temperature air;

selectively transmitting the second control signal passing through the second flow path in accordance with the magnitude of the first variable magnitude control signal;

sensing the temperature of the space being conditioned to vary the magnitude of the second control signal in accordance with the sensed temperature of the space being conditioned; and varying the quantity of variable temperature conditioned air discharged into the space in accordance with the magnitude of the second control signal.

5. A method in accordance with claim 4 further including transmitting said first and second control signals to first and second inflatable members to regulate the quantity of constant and variable temperature air discharged into the space.

* * * * *